United States Patent [19]

Eckert et al.

[11] Patent Number: 4,688,771

[45] Date of Patent: Aug. 25, 1987

[54] ALLOYING SYSTEM

[75] Inventors: Charles E. Eckert, Plum; Ronald E. Miller, Murrysville, both of Pa.

[73] Assignee: Aluminum Company of America, Pittsburgh, Pa.

[21] Appl. No.: 812,946

[22] Filed: Dec. 24, 1985

Related U.S. Application Data

[63] Continuation of Ser. No. 654,735, Sep. 27, 1984, abandoned.

[51] Int. Cl.[4] ..... C22C 1/00

[52] U.S. Cl. ..... 266/78; 266/216; 266/200; 266/207

[58] Field of Search ..... 266/216, 78, 200, 207; 75/10 R, 129; 420/590

[56] References Cited

U.S. PATENT DOCUMENTS

| | | | |
|---|---|---|---|
| 3,137,753 | 6/1964 | Feichtinger | 420/59 C |
| 3,268,326 | 8/1966 | Harder | 420/590 |
| 3,929,185 | 12/1975 | Wiener | 164/338 |
| 3,947,265 | 3/1976 | Guzowski et al. | 75/10 R |

FOREIGN PATENT DOCUMENTS

| | | | |
|---|---|---|---|
| 802133 | 12/1968 | Canada | 420/590 |
| 24764 | 6/1924 | Japan | 266/216 |
| 384406 | 11/1977 | U.S.S.R. | 266/216 |

*Primary Examiner*—Christopher W. Brody
*Attorney, Agent, or Firm*—Carl R. Lippert; Brian D. Smith

[57] ABSTRACT

A system for adding alloying material to molten metal media is disclosed. The system includes spark cup means, preferably cylindrically shaped, which is partially immersed in the molten media. The spark cup preferably has a lower open end which is exposed to a submerged surface of the molten media and an upper inlet, at least a portion of which is located above an exterior surface of the molten media. Means for supplying the spark cup means with an arc shielding gas through the inlet is provided as is means for feeding an elongated form of the alloying material through the spark cup inlet into the cup area or chamber of the spark cup. Also provided is means for establishing an electrical arc discharge between the submerged molten metal surface and the free end of the alloying element in the spark cup. The free end of the alloying element is converted into a spray of superheated alloy materials as it passes through the arc discharge. The shielding gas projects or directs the superheated spray of alloying material into the melt via the submerged surface in the open end of the spark cup. The spark cup is preferably configured to enhance such projection.

10 Claims, 4 Drawing Figures

ALLOYING SYSTEM

This application is a continuation of U.S. Ser. No. 654,735, filed Sept. 27, 1984 now abandoned.

BACKGROUND OF THE INVENTION

The invention relates generally to a method and system for adding alloying elements to molten metals. More particularly, however, it relates to the addition of elements which normally dissolve slowly and with difficulty in molten metals, particularly aluminum.

Many different methods have been employed to add alloying elements to molten metals. Conventional methods typically add the elements directly to the melt in the form of a lump, a bar or the like. In some cases, they are added directly to molten metal being tapped into a ladle, and in other cases, they may be placed in the ladle prior to tapping.

Another method for adding alloying elements to molten metals, particularly molten steel, is disclosed in U.S. Pat. No. 3,768,999 to Ohkubo et al. In Ohkubo, alloying is accomplished by feeding a wire rod into the molten metal. The rod is coated with additives for the molten metal and an organic binder which decomposes into gaseous products in the molten metal. The generated gas stirs the molten metal and thus uniformly incorporates the added components throughout the molten metal.

U.S. Pat. No. 3,729,309 to Kawawa also discloses a method for adding alloying elements in the form of a wire rod to molten metals. The rod has a controlled size and is added to a molten metal bath by inserting it at a controlled speed, so as to produce a refined and purified metal alloy.

The above methods of adding alloying elements to molten metal work fairly well with alloying elements which dissolve and disperse easily in the molten metal. However, such methods do not work so well with elements having limited liquid solubility such as Pb, Bi and Sn and high oxidizing potential such as Mg and Zn.

U.S. Pat. No. 3,947,265 to Guzowski et al proposes a solution to the problem of adding such "hard-to-alloy" materials to molten metal. The process employs a high current arc which is formed between the molten base metal and the alloying addition. The alloying addition is passed through the arc where it is melted and converted into a spray of finely divided superheated molten particles. In such a condition, the particles are able to rapidly dissolve in the molten metal upon contact therewith. While the Guzowski concept of alloying is certainly an interesting one, a need still exists for a process capable of providing improved results.

Accordingly, an object of the present invention is to provide an improved process for adding "hard-to-alloy" alloying materials to molten metals.

Another object of the present invention is to provide an alloying process having high dissolution rates.

Another object of the present invention is to provide an alloying process which is amenable to continuous casting processes.

Another object of the present invention is to provide a lead alloyed, aluminum based metal article having high machinability.

Another object of the present invention is to provide a process for adding alloying material to a molten media that additionally adds heat to the molten media.

Additional objects and advantages of the present invention will become apparent to persons skilled in the art from the following specification and drawings.

SUMMARY OF THE INVENTION

In accordance with the present invention, a method is provided for adding alloying material to a molten metal media, such as molten aluminum. The method includes the step of converting the alloying material into a spray of superheated alloy material and directing the spray into the molten metal media at a predetermined depth below the media's surface, the depth having been determined beforehand to enhance dissolution and dispersion of the alloying material into the molten media.

In a preferred embodiment, the alloying material is converted into the spray of superheated alloy material in a spark cup means which is at least partially immersed in the molten media body. The spark cup has a lower open end which is exposed to the molten media and an upper inlet, at least a portion of which is located above the exposed or exterior surface of the molten media. The lower open end of the spark cup is maintained or immersed a predetermined depth below the surface of the molten media. The alloying material, preferably in the form of an elongated element having a free end, is continually fed into the spark cup through its upper inlet, and an electrical arc discharge between the submerged molten metal surface and the alloying element in the spark cup is maintained with a current that exceeds the globular/spray transition current density of the alloying material. At such a current, the free or exposed end of the alloying element is converted into a spray of superheated material. Arc shielding gas is continually supplied to the spark cup through its upper inlet also. In addition to shielding the arc discharge, the gas slightly pressurizes the spark cup and thereby prevents molten media from entering its open end. As such, a submerged interior surface of molten metal media is created in the spark cup's open end at the aforementioned predetermined depth. The shielding gas also carries or projects the superheated spray of alloy material into the molten media through the submerged molten metal surface so as to permit dissolution and dispersion of the alloy material in the media. The predetermined depth of immersion has been found to significantly enhance dispersion and dissolution of the alloying material into the media.

The present invention also provides a lead alloyed, aluminum based article having high machinability. The article is produced by converting lead alloy material into a spray of superheated alloy material which is injected into a bath of molten aluminum at a predetermined depth below the molten bath's surface. The spray is formed by establishing an electrical arc discharge between a submerged surface of the molten media and the alloying material. The discharge is maintained with a current that exceeds the globular/spray transition current density of the alloying material. The spray of superheated alloying material is directed onto the submerged interior surface of the media where dissolution and dispersion of the alloy material into the media take place. The submerged surface is maintained at the predetermined depth below the bath's surface having been found to enhance said dissolution and dispersion of the lead into molten aluminum bath. The article so produced has acicular shaped particles of lead which are smaller and more uniformly sized and dispersed than those which are made by adding lead at the surface of the molten aluminum or at a depth above the aforesaid predetermined depth.

DETAILED DESCRIPTION OF A PREFERRED EMBODIMENT

Figure 2:
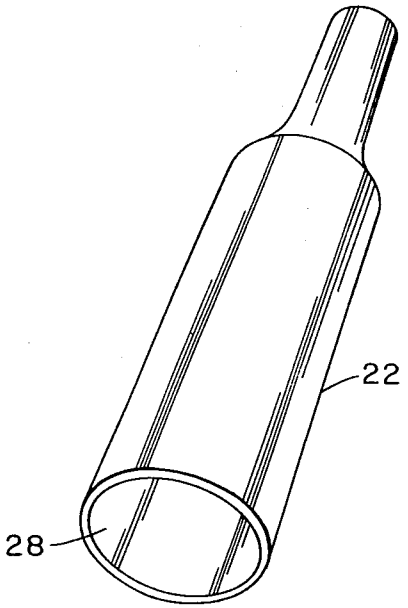
FIG. 2 illustrates the spark cup depicted in FIG. 1.
Figure 1:
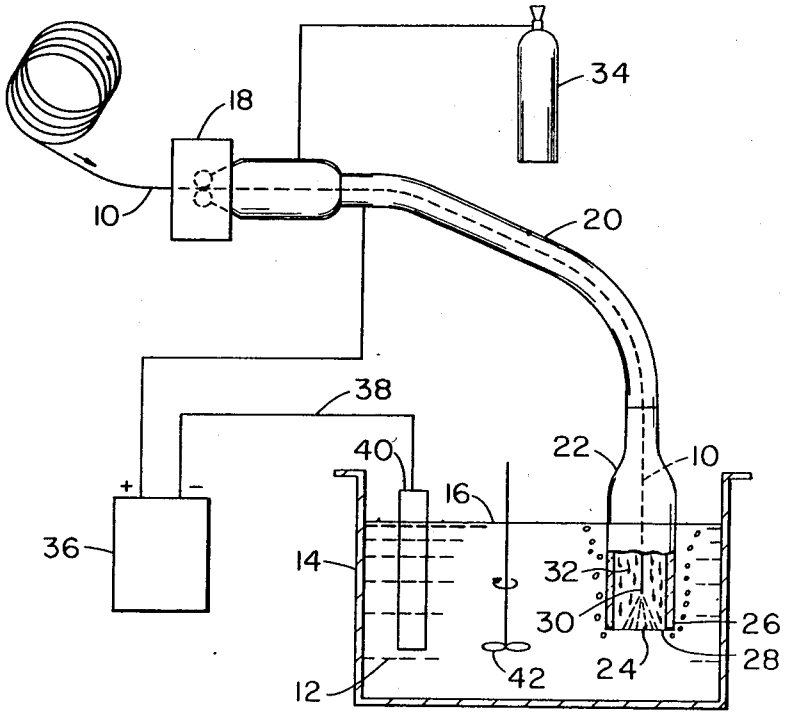
FIG. 1 illustrates an embodiment of the present invention.

FIG. 1 illustrates the addition of a wire 10 of alloying material into a bath or melt 12 of molten media in a flow-through furnace 14. The surface of melt 12 is referred to herein as exposed or exterior surface 16. Wire 10 is being fed by a feeder 18 which passes it through a triplex feed cable 20 into a spark cup 22, the spark cup being partially immersed in melt 12. In spark cup 22, alloy wire 10 is converted into a spray 24 of superheated alloy material by passing it through a plasma arc discharge (not numbered). The plasma arc discharge is established between a submerged surface 26 of the molten metal which is maintained within an open end 28 (see FIG. 2) of spark cup 22 and a free end 30 of alloy wire 10. The arc discharge is shielded with a shielding gas 32, preferably argon, which is provided via feed cable 20 by an arc shielding gas source 34. In addition to providing a shielding atmosphere for the arc in the spark cup, the shielding gas source 34 pressurizes the spark cup at a pressure which is sufficient to prevent molten metal from entering open end 28 of the spark cup. Such pressurization also facilitates maintenance of the aforementioned submerged surface at a certain predetermined depth below exposed surface 16 (more on this, infra). Returning to FIG. 1, it will be seen that the arc discharge is powered by a constant current power supply source 36 (more on this, infra). Melt 12 serves as an anode with wire 10 serving as a consumable electrode. The electrical circuit leading back to current source 36 is completed by a return wire 38 which is attached to a rod 40 immersed in melt 12. The superheated spray produced by the arc discharge is directed or projected by the supply of shielding gas onto submerged surface 26 where the alloy material rapidly dissolves and disperses in melt 12. The gas is preferably supplied at a flow rate that maximizes the projection of the spray into the melt. An impeller 42 or agitating means is also provided to further enhance dispersion of the alloy material throughout the melt. Spray 24 can be maintained as long as is desired by continually advancing or feeding the alloying wire into the spark cup. Feeder 18 can also be controlled to maintain or vary the rate at which wire 10 is fed into the spark cup.

The alloying material can be provided in wire form, as described above, or in the form of rod, tube, strip or in powdered form wherein the powders are encased in a hollow tube made from a suitable metal which has been swaged or otherwise worked to reduce its diameter and compact the powdered material in the tube. The only real limitation on the form of the alloying is that it should have a form which permits it to be fed into the feed cable in a seal-tight fashion, thereby enabling the pressurized atmosphere in the spark cup to be maintained. If the pressurized atmosphere in the spark cup is not maintained, molten metal will, quite obviously, enter the spark cup through its open end 28, thereby raising submerged surface 26 to a depth above its predetermined depth. Such raising of submerged surface 26 will result in lower dissolution and dispersion rates. (The importance of maintaining submerged surface 26 at its predetermined depth will be discussed in more detail, infra.) While no means for sealing the wire is depicted in FIG. 1, those skilled in the art will be aware of numerous means having the capability of providing an effective seal. Such means could include elastomer and pneumatic seals. In addition, feeder 18 is preferably a consistent feed rate tractor drive.

Constant current source 36 is preferably of the type which maintains a relatively constant current regardless of voltage fluctuations. The arc produced thereby has self-stabilizing characteristics and is relatively insensitive to changes in arc length which might be caused by fluctuations in the submerged molten metal depth. It may also be desirable in certain situations to further enhance arc stability by seeding the plasma discharge with certain additives, such as alkali metals which are known to promote arc stability. Arc stability can also be enhanced by using various fluxes known to those skilled in the relevant art.

As mentioned in U.S. Pat. No. 3,947,265 to Guzowski, it may be desirable to add a high frequency, high voltage component to the arc which is particularly useful if AC current is used. This apparently reduces the tendency of the arc to extinguish every time the voltage passes through zero, increases the stability of the arc and makes initiation of the arc less difficult.

An important aspect of the present invention requires that the current supplied by power source 36 exceed the globular/spray transition current density of the alloyed material. As used herein, the globular/spray transition current density defines the boundary line separating the two different types of metal transfer that are capable of occurring in the plasma arc discharge. (As pointed out by Guzowski in U.S. Pat. No. 3,947,265, this transition point can vary with such factors as alloy type, wire size and wire speed.) In cases with current densities below the transition point, alloy material being transferred through the arc detaches into large drops which dissolve and disperse slowly in the molten metal media. At current densities above the transition point, the transfer mechanism changes causing the alloy material to convert a fine spray of superheated alloy material. In this condition, the alloy material rapidly dissolves and disperses in the molten media upon contact with submerged surface 26.

Shielding gas 32 carrying or projecting spray 24 into the melt also typically enters the melt. This, however, should not introduce or cause any melt contamination since such gas simply escapes from the melt by bubbling through the melt to exterior surface 16. As previously mentioned, the preferred shielding gas is argon; however, other shielding gases, such as helium, carbon monoxide and carbon dioxide, may also be used in appropriate situations.

The spark cup is preferably cylindrically shaped. Such a shape provides a relatively high spark cup surface area to volume ratio which facilitates conductive heat transfer from the spark cup to the melt. It is important to facilitate such heat transfer to prevent the spark cup from overheating. Moreover, those skilled in the relevant art will appreciate that such heat transfer to the melt is advantageous in that it provides a convenient way of adding heat to the melt, thereby reducing furnace fuel needs. Conventional alloy adding processes such as that disclosed in Guzowski et al U.S. Pat. No. 3,947,265 do not add much, if any, heat to their respective melts. For example, most of the heat generated during melting of the alloy material in Guzowski et al is lost to the atmosphere since the superheated spray is formed entirely above the melt surface.

The spark cup's cylindrical shape also enhances projection of the shielding gas carrying the superheated spray into the melt. Such projection is important in that it enhances dissolution and dispersion of the alloying material into the melt. While a cylindrical shape is preferred, other shapes, such as an inverted frustoconical shape, which provide enhanced projection and heat transfer are considered to be within the purview of the present invention.

The spark cup's composition is another important aspect of the present invention. Preferably, it is made from material having the following characteristics:

1. High radiation heat transfer so as to maximize the transfer of radiation heat from the arc discharge to the melt, thereby reducing the possibility of overheating in the spark cup.
2. High resistance to thermal and mechanical shock.
3. High thermal and chemical stability in the melt.

Borosilicate, alumina, mullite and silica are some materials known to possess the desired characteristics.

Figure 4:
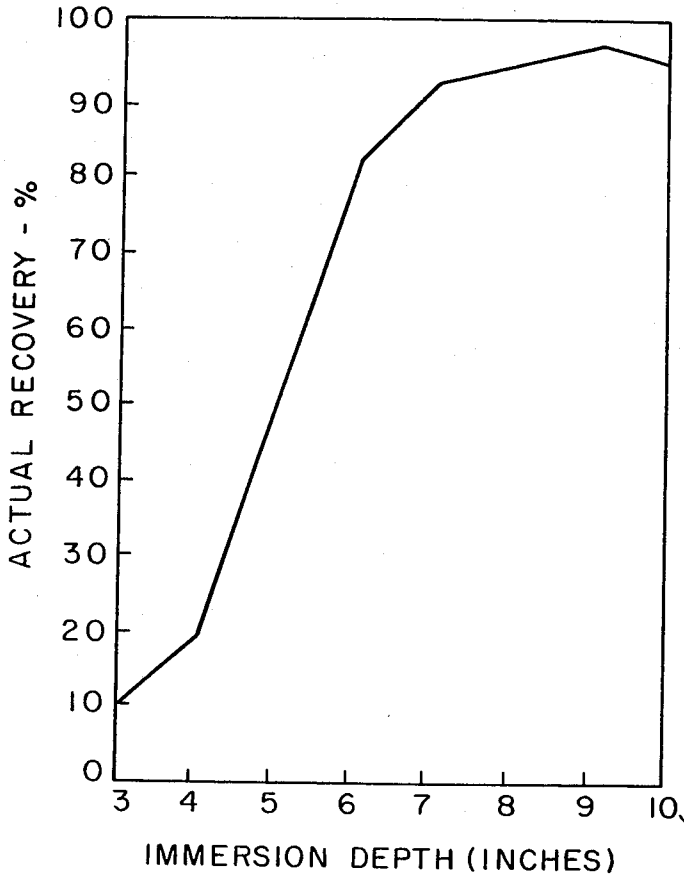
FIG. 4 is a graph illustrating the relationship of actual recovery in percentages versus immersion depth in inches.
Figure 3:
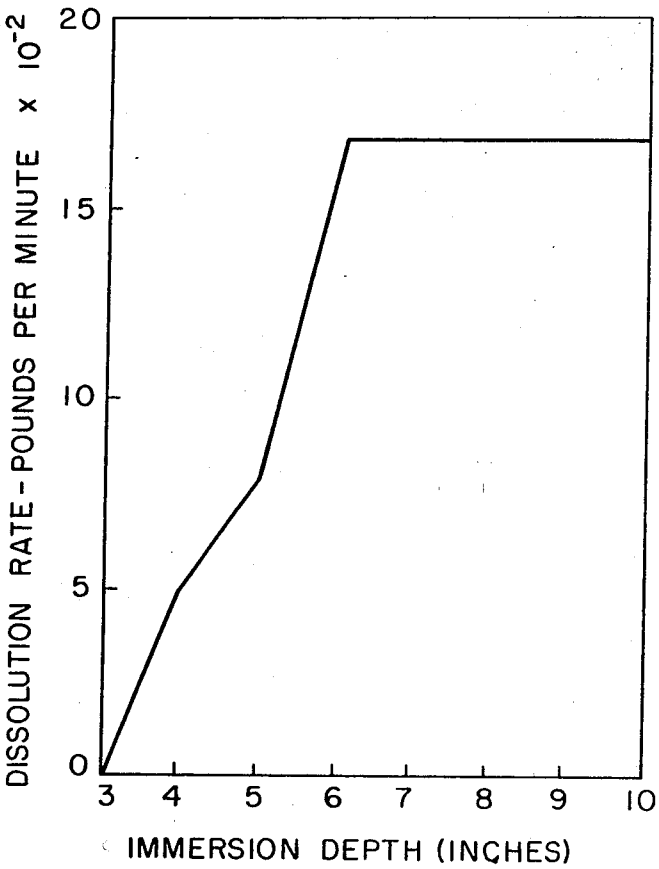
FIG. 3 is a graph plotting alloy dissolution rate in pounds per minute versus spark cup immersion depth.

Another briefly alluded to but important aspect of the present process invention is directed to immersing the spark cup and maintaining submerged surface 26 in the open end of the spark cup at its predetermined depth below exposed surface 16. Such depth will be referred to hereinafter as the predetermined immersion depth. It has been found that a difference of one or two inches in the immersion depth can have a significant impact upon the rate at which alloying material dissolves and disperses in the molten media. FIGS. 3 and 4 set forth test data from experiments conducted to determine the effects of immersion depth upon dissolution and dispersion. FIG. 3 sets forth data respecting dissolution rate in pounds per minute versus immersion depth, and FIG. 4 shows actual recovery in percentages versus immersion depth. The goal of the experiments was to add 0.5% lead to a substantially lead-free body of molten aluminum. The experiments were conducted with a setup similar to that disclosed in FIG. 1 except that a constant voltage supply source was used instead of the preferred constant current supply source. The flow-through furnace used in the experiments contained approximately 1000 pounds of aluminum. The bath of molten aluminum in the furnace had a depth of approximately 30 inches with a diameter of approximately 23 inches. One-eighth inch diameter lead wire was fed into a borosilicate spark cup at a feed rate of about 30 inches per minute via a triplex feed cable. The spark cup was cylindrically shaped and had a lower opening similar to that described in FIG. 1 with a diameter of approximately five centimeters. The spark cup's length to diameter ratio was approximately 6 to 1. Argon shielding gas was fed into the spark cup via the feed cable at a flow rate of about 10 standard $ft^3$/hr. A plasma arc discharge was established in the spark cup between the free end of the lead wire and the submerged molten metal surface at a voltage of about 35 volts and a current of about 125 amperes, which translates into a current density of about 10,000 amp/$in^2$. As such, the free end of the wire melted and converted into an axial spray of superheated alloy material upon entering the arc discharge. The spray was directed onto the submerged melt surface by the shielding gas. After adding an appropriate amount of lead wire to the bath of molten aluminum, the alloyed molten aluminum was continuously cast into several ingots having dimensions of 6 in.×6 in.×36 in.

From FIG. 3, those skilled in the art will appreciate that a dramatic increase in lead's dissolution rate (that is, the rate at which lead dissolved into the molten media) resulted when the spark cup immersion depth was increased from five to six inches. It will be noted that further increases in immersion depth did not seem to have much of an effect upon the dissolution rate. Similarly, in FIG. 4, it can be seen that actual recovery in percentages (i.e., the percentage of alloying material added which actually dissolved in the molten media) increased dramatically when the immersion depth was increased from four to six inches. Moreover, further increases in the immersion depth showed further increases in actual recovery; however, not nearly as dramatic as those that occurred from four to six inches. Actual recovery was measured by optical emission spectroscopy. Metallographic examination revealed that the particles of lead in the cast ingot were smaller, more acicular shaped and more uniformly sized and dispersed than those added by conventional methods. Moreover, it is believed that such ingot provided by the present invention has improved machinability.

While the immersion depth providing enhanced dissolution and dispersion in accordance with the present invention will vary with the material being added, bath size, bath flow rate, alloy feed rate and size, inter alia, and will have to be determined for each setup, those skilled in the relevant art will appreciate that the method and apparatus of the present invention can result in greatly increased dissolution rates, particularly for alloy materials with limited solubility, such as lead, bismuth and tin and for high oxidizable materials such as magnesium and zinc. Moreover, it is anticipated that actual recovery (i.e., the percentage of added alloying material which actually dissolves in the molten media being alloyed) should exceed 50% for most alloying materials. In fact, actual recoveries as high as 95%, such as that obtained with lead, should be attainable in most cases.

Those skilled in the art will also appreciate that the present invention is amenable to continuous casting processes. Continuous casting processes are those that permit the continual flow of metal from a melting furnace into a casting mold. Since continuous casting usually proceeds at a uniform rate, it will be easy to calculate the desired alloy feed rate with the method of the present invention. The invention, however, is particularly amenable to continuous casting processes wherein the casting rate varies. Suitable instrumentation can be installed on the casting line to detect any changes in the casting rate which can then be used to make adjustments in the alloy feed rate.

While the invention has been described in terms of preferred embodiments, the claims appended hereto are intended to encompass all embodiments which fall within the spirit of the invention.

Having thus described the invention and certain embodiments thereof, what is claimed is:

1. A system for adding alloying material to a molten metal media, said system being capable of operating at a commercially significant rate, comprising:

means for providing a body of molten metal media having an exterior surface and an interior surface, said interior surface being provided by (a) elongate chamber means which can be immersed into the media body, said chamber means having a lower open end which can be exposed to the molten media at a substantial depth and an upper inlet, at least a portion of which can be located above the exterior surface of the media, the chamber having a vertical length substantially greater than its inside transverse dimensions;

(b) means for supplying alloying material into the chamber means through the inlet;

(c) means for conducting an electrical arc and maintaining a plasma within said chamber, said plasma extending from the interior surface of the molten media to the material being supplied into the chamber means and means for feeding said material into said plasma and conduct it within said plasma to said interior surface; and (d) means for substantially continuously feeding said gas into the chamber means and pressurizing said chamber and discharging gas from the lower open end of said chamber means so as to project said material through the interior surface of the media such that both said gas and said material enter said media;

said chamber being arranged and constructed to aid in projecting said gas and said material into said media.

2. The system as recited in claim 1 further comprising means for maintaining the molten metal media in motion relative to the chamber means.

3. The system as recited in claim 1 wherein the molten metal media comprises aluminum.

4. The system as recited in claim 1 further comprising means for seeding said gas with at least one additive to promote arc stability or oxygen scavenging.

5. The system as recited in claim 1 wherein the means for feeding gas into the chamber means includes means for controlling the rate at which said gas is fed into the chamber means.

6. The system as recited in claim 1 wherein said means for establishing said arc includes a constant current power supply.

7. The system as recited in claim 1 wherein the chamber means is made from alumina, borosilicate, mullite or silica.

8. The system as recited in claim 1 further comprising means for agitating said molten media to further enhance dissolution and dispersion of said material.

9. The system as recited in claim 1 wherein the chamber means is shaped to facilitate projection of the superheated spray by the gas onto the interior surface of the molten media.

10. The system as recited in claim 1 wherein the chamber is an elongate cylinder constructed to favor heat transmission therethrough.

* * * * *